US006367398B1

(12) United States Patent
Landau

(10) Patent No.: US 6,367,398 B1
(45) Date of Patent: Apr. 9, 2002

(54) REVERSIBLE SCULPTURED RUG AND METHOD OF MANUFACTURE

(75) Inventor: Mordechai Landau, Ganei Yehuda (IL)

(73) Assignee: Caesarea Wardinon Industries, Ltd., Or-Akiva (IL)

( * ) Notice: Subject to any disclaimer, the term of this patent is extended or adjusted under 35 U.S.C. 154(b) by 0 days.

(21) Appl. No.: 09/363,870

(22) Filed: Jul. 29, 1999

(51) Int. Cl.[7] ..... D05C 15/26; D05C 17/02
(52) U.S. Cl. ..... 112/475.08; 112/410
(58) Field of Search ..... 1123/475.08, 80.01, 1123/410, 415, 430; 428/98, 102

(56) References Cited

U.S. PATENT DOCUMENTS 2,409,580 A * 10/1946 Mosseller ..... 112/410
2,662,227 A * 12/1953 Lacey ..... 112/410
3,176,643 A * 4/1965 Spencer ..... 112/410
3,533,893 A * 10/1970 Harsein ..... 112/410
3,970,338 A * 7/1976 Crowe
5,893,332 A * 4/1999 Vourantonis ..... 112/475.08

* cited by examiner

*Primary Examiner*—Ismael Izaguirre
(74) *Attorney, Agent, or Firm*—Brown Raysman Millstein Felder & Steiner LLP

(57) ABSTRACT

An integrally tufted reversible sculptured rug comprising:

a first layer of material having a cut tufted first pile yarn forming on one side of the material a non-sculptured rug surface, the other side of the material being the back side, a second layer of material positioned against the back side of the first material, and a second pile yarn tufted through both the second and first layers of material fixing the two layers of material together and forming a sculptured surface on the second layer of material, said second pile yarn being loop-cut in different heights according to a predetermined pattern.

10 Claims, 1 Drawing Sheet

REVERSIBLE SCULPTURED RUG AND METHOD OF MANUFACTURE

FIELD OF THE INVENTION

This invention relates to a reversible rug and particularly to a rug sculptured on one side, and a method for manufacturing same.

BACKGROUND OF TEE INVENTION

Rugs such as scatter rugs or bathroom rugs are well known. These rugs are made of soft cotton or synthetic yarns and in the case of bathroom rugs, are also water absorbent so that when a person steps unto them coming out from a shower or bathtub the water drops falling on the mat do not accumulate in pools.

Rugs, in general, comprise a tufted fabric having a raised surface of yarn tufts on one side of a primary backing material and a latex under layer to adhere the yarn tufts to the backing. The yarn, such as pile yarn, can be either cut or looped or partly cut and partly looped, to form cut, looped or sculptured rugs on one side only, the other side being either latex or left bare. The backing material is usually made of cotton or synthetic woven or non-woven material. The tufts can be cotton pile or of synthetic fibers. Nylon, and other synthetic filaments such as polyester, have predominantly been utilized as the yarns for tufting bathroom mats because of the resiliency, bulk and strength provided by this type of yarn. Tufting denier nylon filaments have been developed that have the luster level and hand of cotton while retaining the resilience, strength and performance of nylon. Unfortunately these synthetic yarns do not have the absorbency of cotton and are essentially hydrophobic.

More recently, yam producers have developed a hydrophylic microdenier nylon with the absorbency characteristics of cotton or other natural fibers. These nylons are suitable for use in garment fabrics, particularly for sports apparel, to wick moisture from one side of the fabric to the other side of the fabric away from the skin of the wearer or to disburse the moisture throughout the fabric for quick drying of the fabric and to keep the side of the fabric in contact with the skin of the wearer in a dry state. This microdenier nylon is not practical for use in tufted fabrics of the type considered for bathroom mats since it would be too expensive to produce a filament end in the tufting denier range.

U.S. Pat. No. 5,652,038 discloses a tufted fabric and yam for use in bathroom rugs wherein each of the yarn tufts includes hydrophilic microdenier filaments for wicking and distribution of moisture throughout the raised surface of the fabric and hydrophobic tufting denier filaments for providing resiliency, bulk and strength to the fabric.

OBJECT OF THE INVENTION

It is the object of the present invention to provide a reversible rug with one side of the rug being sculptured.

Another object of the present invention was to provide a reversible rug both sides of which have tufted yarn.

Still another object of the invention is to provide a reversible sculptured rug without adhesives.

Yet another object of the invention is to provide an integrally tufted reversible sculptured rug.

A Anther object of the invention to provide a method of manufacturing an integrally tufted reversible sculptured rug.

SUMMARY OF THE INVENTION

In accordance with tis invention there is provided an integrally tufted reversible sculptured rug comprising:

a first layer of material having a cut tufted first pile yarn forming on one side of the material a non-sculptured rug surface, the other side of the material being the back side, a second layer of material positioned against the back side of the first material, and a second pile yarn tufted through both the second and first layers of material fixing the two layers of material together and forming a sculptured surface on the second layer of material, said second pile yarn being loop-cut at different heights according to a predetermined pattern.

The layers of material may comprise any conventional backing material for tufted fabrics, such as of cotton, woven or non-woven synthetic material. However, it is preferred that the first layer of material be a non-woven synthetic fiber material, such as of non-woven polypropylene, and the second layer material be cotton. The tufting yarn may be cotton pile or synthetic fiber yarns, either single or plied yarns, such as from polyacrylic or polyamide fibers or mixtures of these or with cotton.

BRIEF DESCRIPTION OF THE DRAWINGS

The invention will be better understood in conjunction with the following drawings, in which.

DETAILED DESCRIPTION OF THE INVENTION

Figure 1:
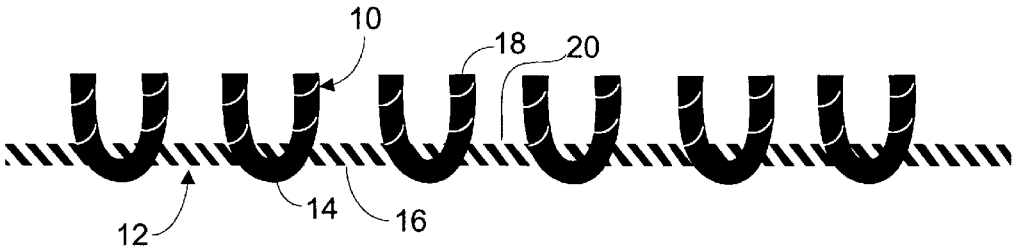
FIG. 1 illustrates the first step in manufacturing the rug.
Figure 2:
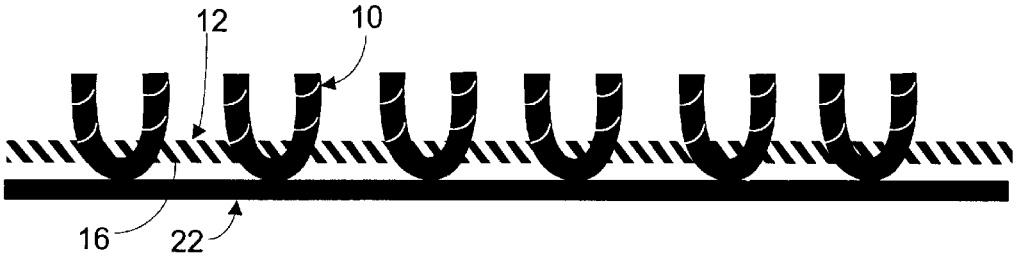
FIG. 2 shows the second step in the manufacture of the rug.
Figure 3:
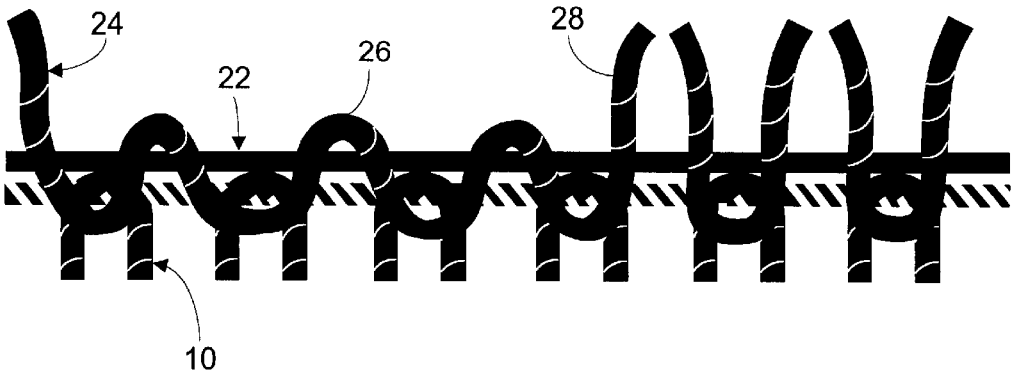
FIG. 3 shows the third step in the manufacture of the rug.

Referring now to FIGS. 1–3, where there are shown the steps for making a rug according to the invention. First, a pile yarn 10 is tufted through a first layer of backing material 12, preferably of non-woven polypropylene. The pile yarn 10 is tufted so that the loop 14 is on one side 16 of the material 12 and the cut 18 on the other side 20 of the material 12. The other side 20 of the material 12 now has a pile rug surface. This stage is conventional for most rugs. The conventional rags would then be coated with latex on the loop side to fix the tufting to the base material. According to the present invention, however, a second layer of backing material 22, preferably of cotton, is placed against side 16 of the fist layer of backing material 12 (FIG. 2), and a second pile yam 24 is tufted through both, the second 22 and first 12 layers of backing material, thereby fixedly attaching the two backing materials 12 and 22 to each other. The tufting of the second pile yarn 24 is in the opposite direction than the tufting of the first pile yarn 10 and forms a sculptured surface by tug the yarn 24 both looped 26 and cut 28 in different heights which form patterns as desired. Because the pile yarns 10 and 24 are densely intertufted there is no need for an adhesive to hold the rug together. Moreover, the second backing layer 22 which is preferably made of cotton shrinks somewhat and causes a tightening of the weave in this second backing material 22, thereby displacing the angle of the axis of the pile yarn 24 above and below the backing materials 10 and 22.

It will be appreciated by persons skilled in the art that the scope of the present invention is not limited to what has been shown and described hereinabove, merely by way of example. Rather, the scope of the invention is limited solely by the claims which follow.

What is claimed is:

1. An integrally tufted reversible sculptured rug comprising:

a first layer of material having a cutted first pile yarn forming on one side of the material a non-sculptured rug surface, the other side of the material being the back side, a second layer of material positioned against the back side of the first material, and a second pile yarn tufted through both the second and first layers of material fixing the two layers of material together and forming a sculptured surface on the second layer of material, said second pile yarn being loop-cut in different heights according to a predetermined pattern.

2. An integrally tufted reversible sculptured rug as in claim 1, wherein the first layer of material is a non-woven synthetic fabric.

3. An integrally tufted reversible sculptured rug as in claim 2, wherein the first layer of material is comprised of non-woven polypropylene.

4. An integrally tufted reversible sculptured rug as in claim 1, wherein the first layer of material is cotton.

5. An integrally tufted reversible sculptured rug as in claim 4, wherein the cotton layer is shrunk to tighten the weave of the second layer of material.

6. A method of manufacturing an integrally tufted reversible rug comprising the steps:

tufting a pile yarn through a first backing material and cutting the pile yarn to form a rug surface on one side of the material, positioning a second backing material against other side of the first material, tufting a pile yarn through both the second and first materials at predetermined different heights of loop-cut pattern thereby forming a sculptured rug surface on the second backing material and at the same time attaching the two backing materials together without requiring adhesive.

7. A method as in claim 6, wherein the first backing material is a non-woven material.

8. A method as in claim 7, wherein the backing material is non-woven polypropylene.

9. A method as in claim 6, wherein the second backing material is cotton.

10. A method as in claim 9, wherein the second backing layer is shrunk to form a tighter tuft.

* * * * *